US006283008B1

(12) United States Patent
Schönewald et al.

(10) Patent No.: US 6,283,008 B1
(45) Date of Patent: Sep. 4, 2001

(54) SHOCK-PROOF HYDRAULIC CYLINDER

(75) Inventors: Peter Schönewald, Stapelfeld; Christian Baerwolff; Heniz Gaffke, both of Hamburg, all of (DE)

(73) Assignee: Still GmbH, Hamburg (DE)

( * ) Notice: Subject to any disclaimer, the term of this patent is extended or adjusted under 35 U.S.C. 154(b) by 0 days.

(21) Appl. No.: 09/403,728

(22) PCT Filed: Apr. 23, 1998

(86) PCT No.: PCT/EP98/02408

§ 371 Date: Apr. 12, 2000

§ 102(e) Date: Apr. 12, 2000

(87) PCT Pub. No.: WO98/49451

PCT Pub. Date: Nov. 5, 1998

(30) Foreign Application Priority Data

Apr. 28, 1997 (DE) ..... 297 07 639 U

(51) Int. Cl.[7] ..... F15B 15/20
(52) U.S. Cl. ..... 91/392; 91/405
(58) Field of Search ..... 91/392, 395, 404, 91/405; 92/85 B

(56) References Cited

U.S. PATENT DOCUMENTS 3,213,760 * 10/1965 Carr ..... 91/395
4,638,717 * 1/1987 Carr ..... 92/85 B

FOREIGN PATENT DOCUMENTS 12 93 026 4/1969 (DE) .
22 54 495 5/1974 (DE) .
36 06 515 8/1986 (DE) .
0 622 331 11/1994 (EP) .

* cited by examiner

*Primary Examiner*—Edward K. Look
*Assistant Examiner*—Thomas E. Lazo
(74) *Attorney, Agent, or Firm*—Millen, White, Zelano & Branigan, P.C.

(57) ABSTRACT

The invention relates to a shockproof hydraulic cylinder that has a cylinder housing (1), in which a plunger (4) that is driven via a plunger shaft (10) is arranged to move axially, and optionally a hollow-cylinder damping plunger (11).

Using different embodiments, an end-position damping is carried out on one or both sides.

Plunger shaft (10), plunger (4) and damping plunger (11) can be designed in a hollow-cylinder form.

10 Claims, 2 Drawing Sheets

SHOCK-PROOF HYDRAULIC CYLINDER

The invention relates to a shockproof hydraulic cylinder that has a) a cylinder housing, in which a plunger that is connected to a plunger shaft is arranged to move axially, and b) an annular cylinder chamber, defined by the inner surface of the cylinder housing, the outer surface of the plunger shaft, the bottom side of the plunger shaft guide of the cylinder head and the top side of the plunger, c) whereby in its lower area, the plunger shaft has at least one opening that connects the outside of the plunger shaft to a hydraulic medium reservoir and that is sealed by the plunger shaft guide of the cylinder head shortly before the upper plunger end position is reached.

Such hydraulic cylinders are used as, i.a., lifting cylinders for industrial trucks. From DE-OS 36 06 515 is known a hydraulic cylinder that is shockproof, but that consists of only a simple hydraulic arrangement. The transport of sensitive items requires that lifting shocks, which under certain circumstances create loud noises and can damage sensitive cargo items, are avoided as much as possible. This cannot be achieved with the hydraulic cylinder that is known from DE-OS 36 06 515. Moreover, it is disadvantageous in the case of this hydraulic cylinder that no other consumers may be downstream from the cylinder.

The object of this invention is to indicate a hydraulic cylinder that makes possible improved shockproofing.

To achieve this object, the invention proposes that the cylinder chamber be connected to a hydraulic medium reservoir via a defined choke site.

Figure 1:
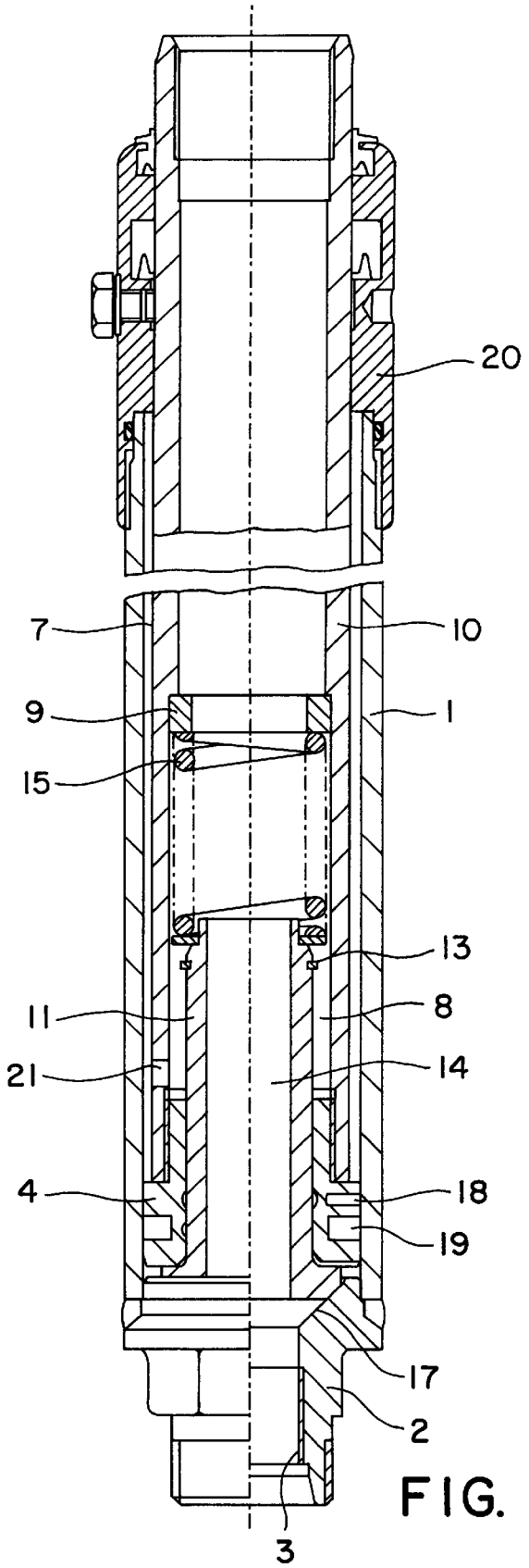
Figure 2:
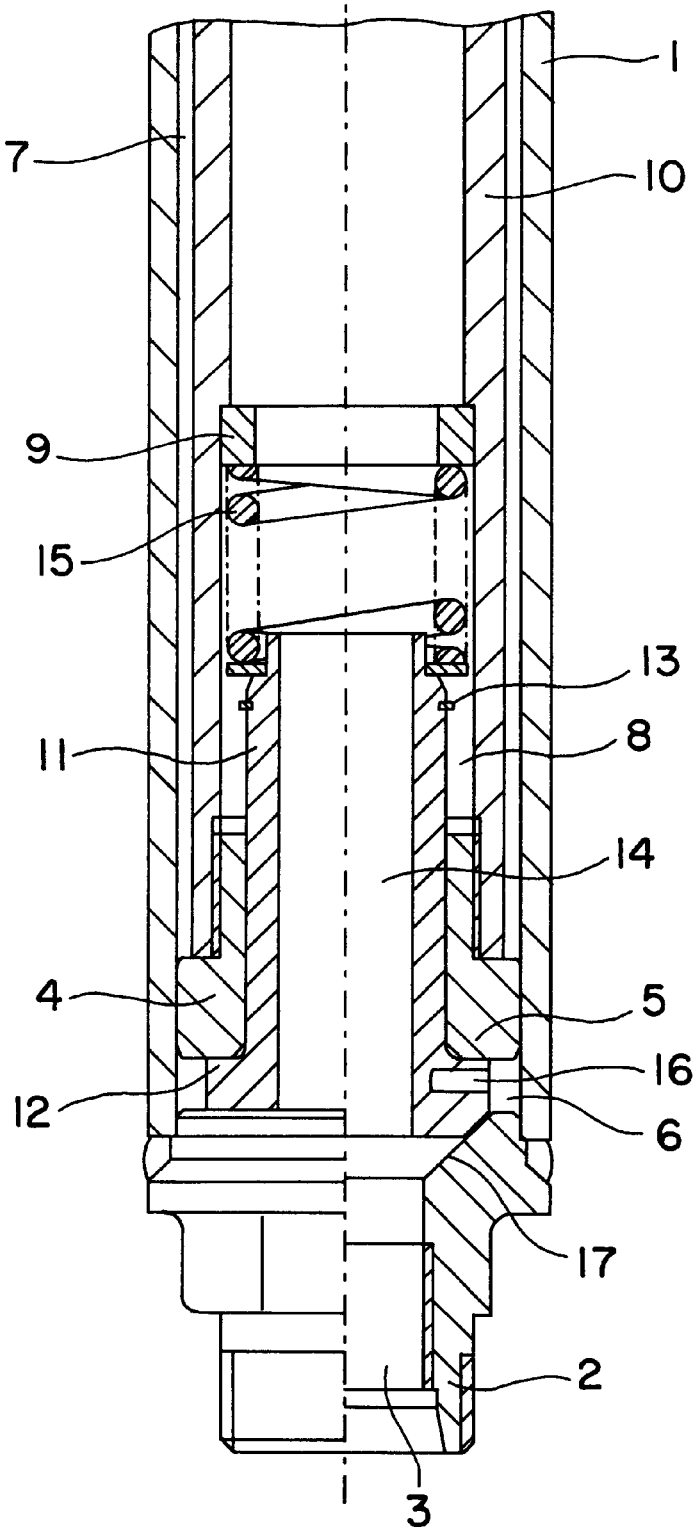

The invention as well as other configurations thereof can be explained in more detail based on FIGS. 1 and 2, which represent two possible embodiments of the shockproof hydraulic cylinder according to the invention.

Cylinder housing 1 is sealed off at one of the fronts by a cylinder plate 2. Cylinder plate 2 has at least one intake and drain opening 3 for a hydraulic medium. This intake and drain opening 3 is connected to a hydraulic medium line that is not shown in the figures. The intake and drain opening 3 comprises a section that is designed in the shape of a central bore coaxially with a cylindrical bore of cylinder housing 1.

Inside cylinder housing 1, an axially movable plunger 4 is arranged, which is connected to a plunger shaft 10. Unlike the figure depiction, plunger 4 and plunger shaft 10 can also, of course, be designed in one piece. A ring gap of small width is provided between plunger 4 and cylinder housing 1. Plunger 4 can have a cylindrical bore 8, in which a hollow-cylinder damping plunger 11 is arranged.

In its lower area, plunger shaft 10 has at least one opening, which is preferably designed as bore 21. This opening is sealed when the upper plunger end position is reached by the plunger rod guide of cylinder head 20. The (hydraulic) medium that remains in annular cylinder chamber 7, which is defined by the inner surface of cylinder housing 1, the outer surface of the plunger shaft, the bottom side of the plunger shaft guide of the cylinder head and the top side of the plunger, is displaced according to the invention by a defined choke site from annular cylinder chamber 7 in a hydraulic medium reservoir. This hydraulic medium reservoir can be formed by, for example, a hollow plunger shaft 10. By means of the defined choke site, an adequate damping or shockproofing can be carried out both in the downward movement and in the upward movement of plunger 4.

As depicted in FIG. 1, a bore 18, by which the (hydraulic) medium that is to be displaced is drained off from annular cylinder chamber 7, can be provided in plunger 4. As an alternative or in addition, a bore 18 can be provided in an existing damping plunger 11.

In this case, it is advisable that a seal 19 be provided between cylinder housing 1 and plunger 4.

In turn as an alternative or in addition to plunger bore 18 that is depicted in FIG. 1, the defined choke site can be designed as a defined gap between the outer surface of plunger 4 and the inner surface of cylinder housing 1 and as a defined gap between the inner surface of plunger 4 and the outer surface of damping plunger 11.

According to the invention, plunger shaft 10, plunger 4 and—if present—damping plunger 11 are designed in a hollow-cylinder form in the case of the shockproof hydraulic cylinder. As a result, it is achieved that independently of the position of plunger 4 and damping plunger 11 inside cylinder housing 1, optionally other consumers can be supplied with hydraulic medium, in particular with hydraulic oil.

The embodiment of the hydraulic cylinder according to the invention that is depicted in FIG. 2 exhibits a hollow-cylinder damping plunger 11. In its lower area that faces cylinder plate 2, the cylinder has at least one opening 16; for the sake of clarity, only one opening 16 is depicted in FIG. 2. Hollow-cylinder damping plunger 11 is arranged to move axially in cylindrical bore 8 of plunger 4.

Plunger 4 is also prestressed in the direction of intake and drain opening 3 by means of a spring 15, which preferably is designed as a coil spring—as depicted in FIGS. 1 and 2. In addition, damping plunger 15 has a stop 13, by which the maximum relative shift of damping plunger 11 relative to plunger 4 is limited. Spring 15 is supported on its upper end that faces away from cylinder plate 2 on an annular part 9 of plunger shaft 10. In a corresponding embodiment of plunger shaft 10, this annular part 9 can be eliminated.

On its side that faces cylinder plate 2, plunger 4 has a pressure pad 5, which determines or defines a cylinder chamber 6 that is arranged inside the cylinder bore and at the level of intake and drain opening 3. Another annular cylinder chamber 7 is defined by the inner surface of cylinder housing 1 and by the outer surface of plunger shaft 10.

If plunger 4 is moved via plunger shaft 10 downward, in the direction of cylinder plate 2, the bottom side of damping plunger 11 first strikes valve seating 17. The latter is made in cylinder plate 2 in the innermost end of the bore of intake and drain opening 3. While plunger shaft 10 and plunger 4 move further downward, in contrast to damping plunger 11 that is already stationary, cylinder chamber 6 continuously decreases in size. The hydraulic medium that is in cylinder chamber 6 partially flows through the ring gap between plunger 4 and cylinder housing 1 into cylinder chamber 7.

The residual hydraulic medium that is in cylinder chamber 6 can now go through opening 16 of damping plunger 11 into cylindrical bore 14 and via the latter into intake and drain opening 3. In the case of a corresponding sizing of opening(s) 16, this overflow of hydraulic medium from cylinder chamber 6 into cylindrical space 14 is carried out in such a way that the bottom side of plunger 4 comes to rest on stop 12 of damping plunger 11 without impact.

Rather, a gap remains, according to another advantageous embodiment of the invention, between cylinder housing 1 and plunger 4. Using this embodiment, eccentricity deviations between damping plunger 11 and the seating in cylinder plate 2 can be compensated for.

The lower end of damping plunger 11 is preferably spherical in design. Using this embodiment of the hydraulic cylinder according to the invention, deviations of the angularity between damping plunger 11 and valve seating 17 in cylinder plate 2 can be compensated for, by which an optimum seal in valve seating 17 is achieved.

What is claimed is:

1. A shockproof hydraulic cylinder comprising a) a cylinder housing (1), in which a plunger (4) that is connected to a plunger shaft (10) is arranged to move axially, and b) an annular cylinder chamber (7), defined by the inner surface of cylinder housing (1), the outer surface of plunger shaft (10), the bottom side of the plunger shaft guide of cylinder head (20) and the top side of plunger (4), and said cylinder chamber 7 is connected to a hydraulic medium reservoir via a defined choke site, c) whereby in its lower area, plunger shaft (10) has at least one opening that connects the outside of the plunger shaft with a hydraulic medium reservoir and that is sealed by the plunger shaft guide of cylinder head (20) shortly before the upper plunger end position is reached, and d) a hollow-cylinder damping plunger (11), which is arranged to move axially in cylindrical bore (8) of plunger (4), which is prestressed by means of a spring (15).

2. A shockproof hydraulic cylinder according to claim 1 wherein said hollow-cylinder damping plunger (11), which is arranged to move axially in cylindrical bore (8) of plunger (4), is prestressed by means of said spring (15) in the direction of an intake and drain opening (3) that is provided in cylinder plate (2) for a hydraulic medium, and which has at least one stop (13), which limits the maximum relative shifting of damping plunger (11) relative to plunger (4).

3. A shockproof hydraulic cylinder according to claim 1, wherein plunger (4) has at least one pressure pad (5), which determines a cylinder chamber (6) that is arranged inside of the cylinder bore and at the level of intake and drain opening (3), and whereby if plunger (4) and plunger shaft (10) move into a position near intake and drain opening (3) or move away from this position, damping plunger (11) already or still rests on valve seating (17), and cylinder chamber (6) is connected to intake and drain opening (3) only via opening (16) of damping plunger (11).

4. A shockproof hydraulic cylinder according to claim 2, wherein the end of damping plunger (11) that faces cylinder plate (2) is spherical in design.

5. A shockproof hydraulic cylinder according to claim 1, wherein the opening that is provided in plunger shaft (10) is designed as a bore (21).

6. A shockproof hydraulic cylinder according to claim 1, wherein the defined choke site is designed as a bore (18) that is provided in plunger (4) and/or damping plunger (11).

7. A shockproof hydraulic cylinder according to claim 1, wherein a seal (19) is provided between cylinder housing (1) and plunger (4).

8. A shockproof hydraulic cylinder according to claim 1, wherein the defined choke site is designed as a defined gap between the inner surface of plunger (4) and the outer surface of damping plunger (11).

9. A shockproof hydraulic cylinder according to claim 1, wherein plunger shaft (10), plunger (4) and damping plunger (11) are designed in a hollow-cylinder form.

10. A shockproof hydraulic cylinder according to claim 1, wherein plunger shaft (10) has an outside diameter that is larger than the largest outside diameter of damping plunger (11).

* * * * *

UNITED STATES PATENT AND TRADEMARK OFFICE

CERTIFICATE OF CORRECTION

PATENT NO. : 6,283,008 B1
DATED : September 4, 2001
INVENTOR(S) : Schonewald et al.

It is certified that error appears in the above-identified patent and that said Letters Patent is hereby corrected as shown below:

Column 3,
Line 10, reads "7" should read -- (7) --;
Line 31, reads "claim 1" should read -- claim 2 --

Signed and Sealed this

Fourteenth Day of May, 2002

*Attest:*

*Attesting Officer*

JAMES E. ROGAN
*Director of the United States Patent and Trademark Office*